United States Patent [19]

Oliff

[11] Patent Number: 4,491,223

[45] Date of Patent: Jan. 1, 1985

[54] WRAPAROUND ARTICLE CARRIER WITH ADJUSTABLE GIRTH

[75] Inventor: James R. Oliff, Austell, Ga.

[73] Assignee: The Mead Corporation, Dayton, Ohio

[21] Appl. No.: 597,078

[22] Filed: Apr. 5, 1984

[51] Int. Cl.[3] ..... B65D 71/00; B65D 85/62

[52] U.S. Cl. ..... 206/434; 206/140; 206/427; 229/40

[58] Field of Search ..... 206/140, 427, 434; 229/40

[56] References Cited

U.S. PATENT DOCUMENTS

| | | | |
|---|---|---|---|
| 3,478,951 | 11/1969 | Graser | 206/140 |
| 3,508,699 | 4/1970 | Graser | 206/140 |
| 4,077,095 | 3/1978 | Oliff | 206/140 |
| 4,093,116 | 6/1978 | Watkins et al. | 229/40 |
| 4,355,717 | 10/1982 | Oliff | 206/427 |
| 4,373,630 | 2/1983 | Oliff | 206/434 |
| 4,374,562 | 2/1983 | Oliff | 229/40 |

*Primary Examiner*—William T. Dixson, Jr.
*Assistant Examiner*—Brenda J. Ehrhardt
*Attorney, Agent, or Firm*—Rodgers & Rodgers

[57] ABSTRACT

For packaging groups of articles whose exterior dimensions may vary somewhat, an article carrier of the wraparound type comprises a blank of generally rectangular configuration having lap panels at its ends which may be overlapped and secured together in flat face contacting relation in alternate relative positions of long and short overlaps to form tubular structures of different girths respectively wherein at least one combination locking and retaining tab is struck from each of the lap panels and defining a locking edge in each lap panel which is disposed at the swing end of the associated combination tab, one of the combination tabs being longer from its base to its swing end than the corresponding dimension of the other combination tab so that locking movement of the one combination tab from an outer overlapping position of the associated lap panel through the aperture defined by the other of the combination tabs causes the base of the one combination tab to engage the locking edge defined by the other combination tab to establish a predetermined girth for the carrier and to establish a different girth when the lap panels are interchanged with the other combination tab serving as a loading tab.

7 Claims, 7 Drawing Figures

WRAPAROUND ARTICLE CARRIER WITH ADJUSTABLE GIRTH

TECHNICAL FIELD

This invention relates to article carriers of the wraparound type and is concerned with improved interlocking means whereby a particular carrier may be used for groups of articles having dimensions which vary somewhat from one group to the other.

BACKGROUND ART

U.S. Pat. No. 4,355,717 discloses a wraparound carrier which is provided with special locking and retaining tabs and associated apertures whereby bottles of different sizes may be readily accommodated without effecting machine adjustments by simply reorienting the blank in its hopper so as to interchange the ends thereof. This particular arrangement is well suited for use in connection with groups of bottles which vary substantially in diameter.

DISCLOSURE OF THE INVENTION

While the arrangement of U.S. Pat. No. 4,355,717 is specially adapted for use in conjunction with bottle sizes which vary considerably, this invention is particularly well adapted for use in conjunction with groups of bottles which vary but slightly from group to group.

In accordance with this invention in one form, an article carrier of the wraparound type is provided in which groups of articles which may vary in size somewhat from group to group may be accommodated and wherein a combination locking and retaining tab is formed in each lap panel one of which may occupy an outer position relative to the face contacting inner lap panel so that when the one combination locking and retaining tab is driven through an aperture defined by a combination locking and retaining tab formed in the other inner lap panel, a secure lock is provided and results in a wrapper which is of a different girth dimension from that formed when the combination locking and retaining tab formed in the other lap panel is driven through an aperture defined by the combination locking and retaining tab formed in the one lap panel, the other lap panel occupying an outer position relative to the one lap panel.

BEST MODE OF CARRYING OUT THE INVENTION

Figure 1:
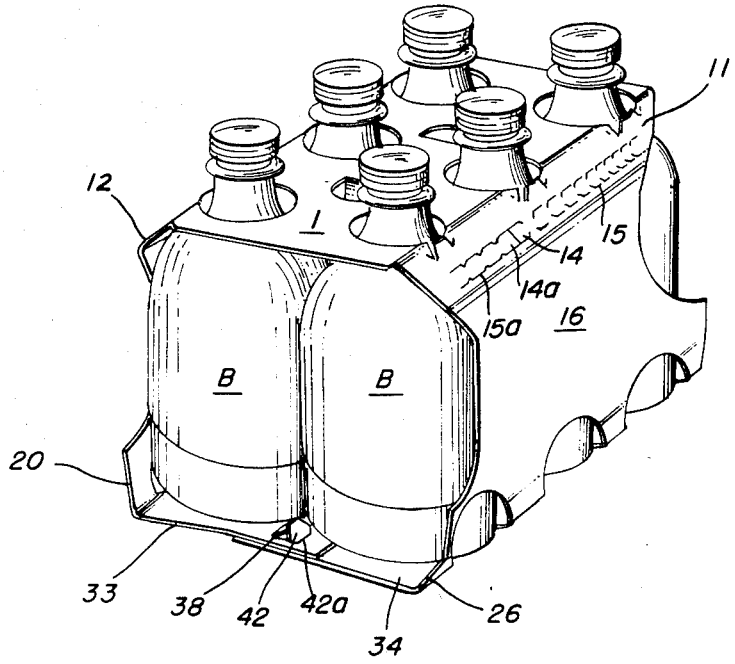
FIG. 1 is a perspective view of a set-up carton of the wraparound type which is formed according to this invention.

In the drawings, the numeral 1 designates a top panel having finger gripping tabs 2 and 3 struck out of the top panel 1 to define finger receiving openings to facilitate portability of the carrier. Also formed in top panel 1 are a plurality of apertures 4, 5, 6, 7, 8 and 9 which are of known construction and which are for the purpose of receiving the necks of packaged articles as is apparent for example in FIG. 1. The apertures 4–9 formed in top panel 1 are provided with especially constructed cut and slit lines generally indicated at **4*a* and which are of known construction and form no part of the present invention. Foldably joined along fold line 10 to one edge of top panel 1 is a sloping panel 11 while a similar sloping panel 12 is foldably joined along fold line 13 to the opposite edge of top wall 1. Suitable pull tabs 14 and 14*a* and a series of tear slits 15 and 15*a* of known construction are formed in side wall 16 which is foldably joined to the bottom edge of sloping panel 11 along fold line 17**.

On the other side of the carrier, a side wall 18 is foldably joined to the bottom edge 19 of sloping panel 12.

Sloping panel 20 is foldably joined to the bottom edge of side wall 18 along fold line 21 and includes a plurality of apertures 22, 23, and 24 which extend into side wall 18 and which are of known construction and which receive the heels of adjacent bottles.

On the opposite side of the carrier, a sloping panel 26 is foldably joined along fold line 27 to the bottom edge of side wall 16 and a plurality of apertures 28, 29 and 30 are formed in sloping panel 26 and in the lower portion of side wall 16. Apertures 28–30 receive the heels of the adjacent bottles.

Foldably joined to the lower edge 32 of sloping panel 20 is a bottom lap panel 33 while a bottom lap panel 34 is foldably joined to the lower edge **26*a* of sloping panel 26. As is well known, lap panels 33 and 34 are disposed in overlapped face contacting relation and are secured together to form a secure tubular wrapper which receives a group of packaged articles such as bottles "B" as shown in FIG. 1**.

Figure 3:
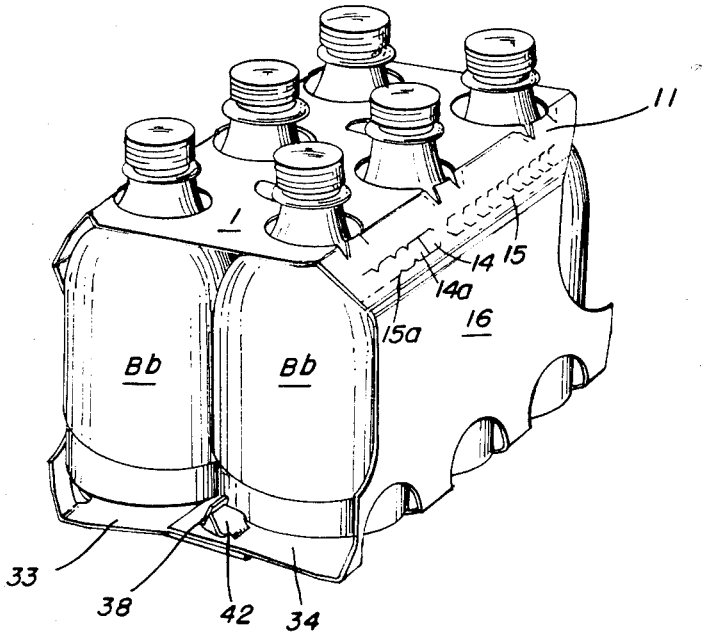
FIG. 3 is a perspective view of the carton shown in FIG. 1 but which shows the bottom lap panels with their relative positions unchanged from that shown in FIG. 1 to provide a carrier having a different girth from that of the carrier of FIG. 1.
Figure 2:
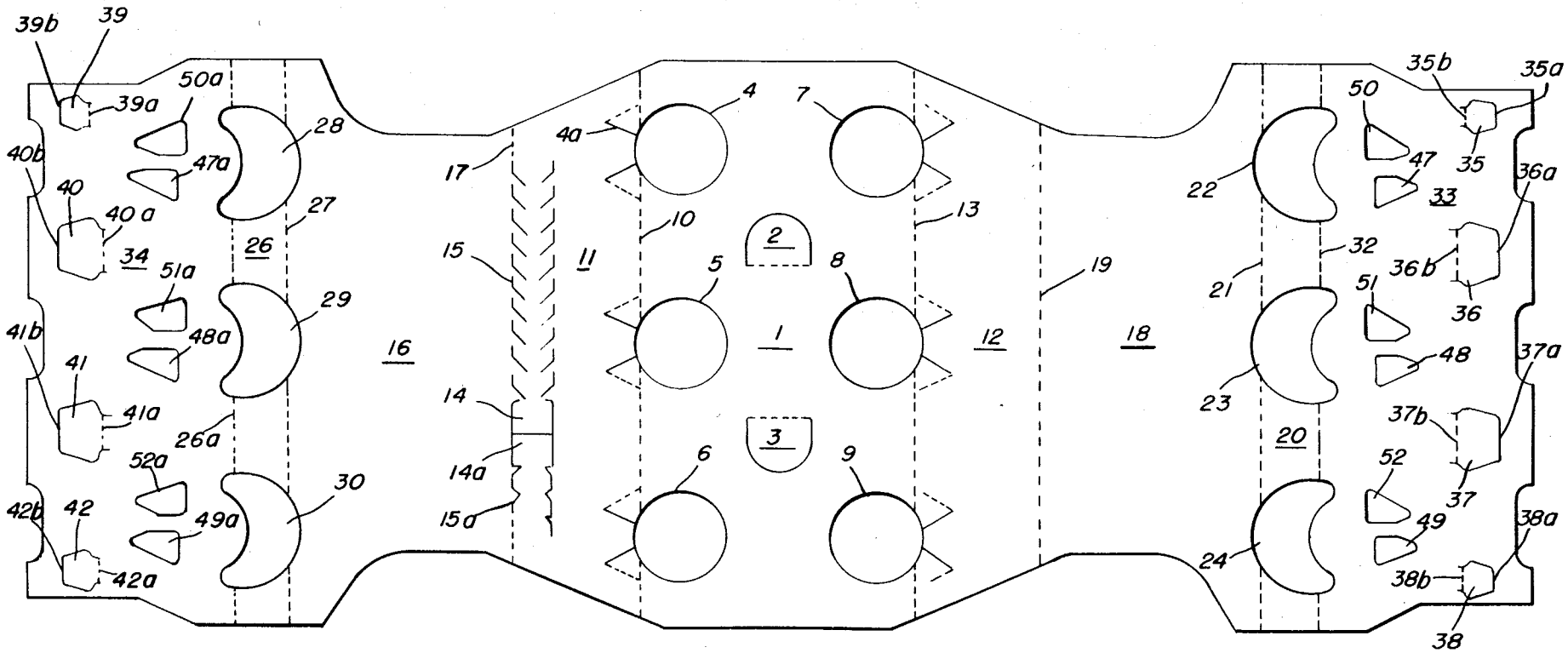
FIG. 2 is a plan view of a blank as viewed from its outside surface and which is used to form the package of FIG. 1.
Figure 4:
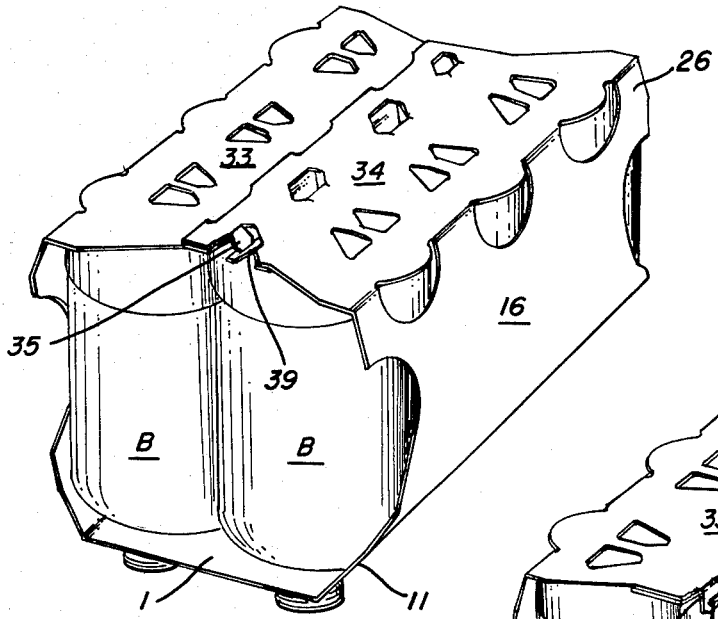
FIG. 4 is a perspective view of the carton shown in FIG. 1 but which is shown in upside down position and partially broken away so as to indicate the inner locking structure formed according to this invention.
Figure 5:
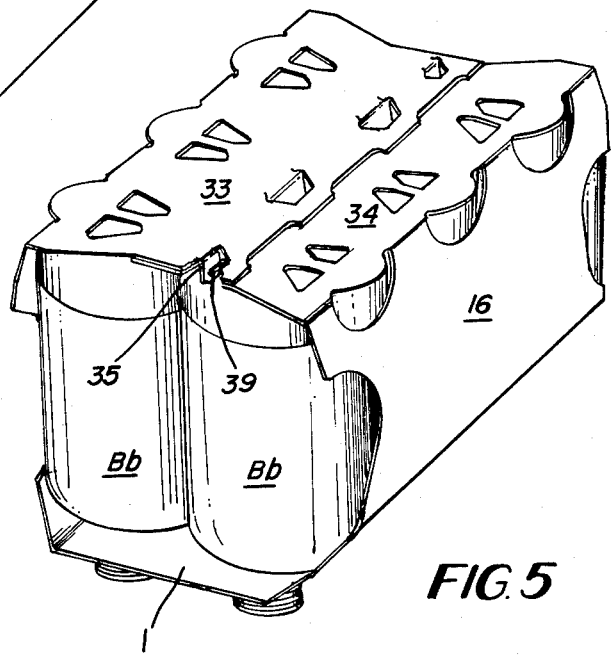
FIG. 5 is a perspective view of the carton of FIG. 3 shown upside down and partially broken away so as to show the orientation and cooperation of the interlocking means formed according to this invention and which affords a carton of different girth from that shown in FIGS. 1 and 4.

The articles shown in FIGS. 1 and 4 include cup shaped bottom portions and are generally slightly smaller than the bottles Bb shown in FIGS. 3 and 5. Thus according to this invention in one form, bottles of both sizes are packaged securely in a single wrapper formed according to this invention. In order to achieve this result without making machine tightening element changes, it is simply necessary to rotate the blanks 180° about a center line which is normal to the blank face.

With reference to lap panel 33, it is apparent that combination locking and retaining tabs 35–38 are struck from lap panel 33. These combination locking and retaining tabs define locking edges **35*a*, 36*a*, 37*a* and 38*a* respectively. With panel 33 disposed above lap panel 34 as shown in FIG. 1, locking tabs 39–42 in lap panel 34** respectively may be driven through the apertures defined by combination locking and retaining tabs 35–38 respectively. When so arranged, combination locking and retaining tabs 35–38 function as retaining tabs and serve to prop the associated locking tabs such as 39–42 respectively in secure and locked positions as shown in FIG. 1 with the base portion 42*a* of locking tab 42 disposed in secure engagement with the locking edge 38*a* of combination locking and retaining tab 38 and the girth of the wrapper extends longitudinally along the blank from base 42*a* to locking edge 38*a*. Of course the combination locking and retaining tabs 39–41 are similarly oriented with respect to the openings defined by combination locking and retaining tabs 35–37 respectively and their associated locking edges 35*a*–37*a* respectively. With the wrapper secured as described and as shown in FIGS. 1 and 4, bottles of a certain size are securely accommodated.

In order to accommodate bottles somewhat larger than the bottles shown in FIGS. 1 and 4 and such as are shown at Bb in FIGS. 3 and 5, the wrapper is manipulated so that lap panel 34 is disposed above and in face contacting relationship with lap panel 33 as shown in FIG. 3. When so arranged, combination locking and retaining tabs 35–38 are driven through the apertures defined by combination locking and retaining tabs 39–42 respectively which are formed in lap panel 34. Tabs 35–38 function as locking tabs and the tabs 39–42 respectively function as retaining tabs and the base portions 35*b*–38*b* are disposed in abutting contact with locking edges 39*b*–42*b* respectively and the space between these parts is the girth dimension of the wrapper. The result is a carrier as shown in FIGS. 3 and 5 which is of larger girth than the carrier shown in FIGS. 1 and 4 and which therefore securely accommodates bottles Bb which are somewhat larger than the bottles B shown in FIGS. 1 and 4.

This result is achieved because combination locking and retaining tabs 39–42 are of a smaller dimension from their bases 39*a*–42*a* to their locking edges 39*b*–42*b* than are the combination locking and retaining tabs 35–38.

In order properly to tighten the wrapper about the groups of articles, tightening apertures are provided in lap panels 33 and 34 and are designated 47–49 in lap panel 33 and are designated 47*a*–49*a* in lap panel 34. Suitable machine tightening elements enter these tightening apertures and tighten the package for the larger group of articles as shown for example in FIGS. 1 and 4 prior to locking these lap panels together.

In like fashion tightening apertures 50–52 are formed in lap panel 33 and cooperate with tightening apertures 50*a*–52*a* formed in lap panel 34 so as to form the package such as that shown in FIGS. 3 and 5.

The arrangement of tightening apertures formed in lap panels 33 and 34 and their cooperation with machine tightening elements are disclosed and claimed in U.S. Pat. No. 4,373,630 issued Feb. 15, 1983 and assigned to the assignee of this invention.

Figure 7:
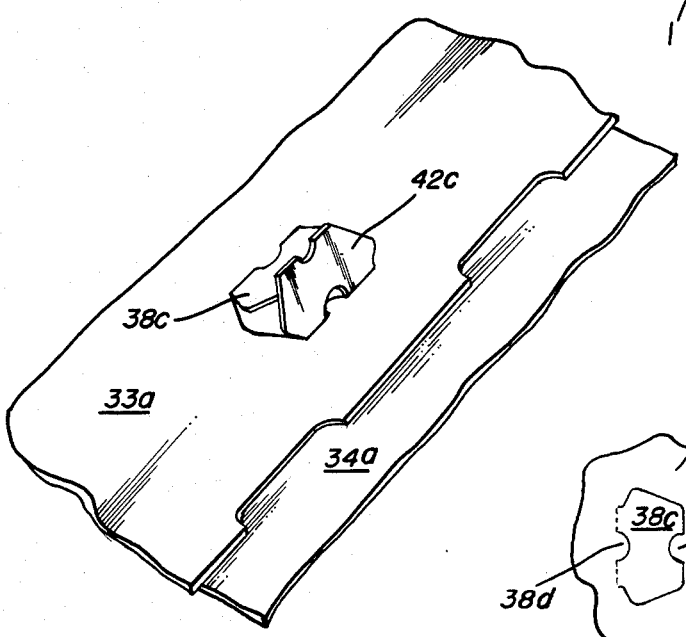
FIG. 7 is a fragmentary view showing the elements of FIG. 6 in locked condition.
Figure 6:
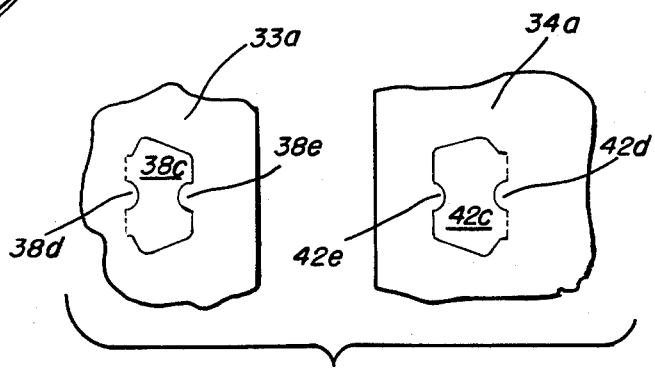
FIG. 6 is a fragmentary view of each of the lap panels of a wraparound carrier and which shows combination locking and retaining tabs formed according to a modification of this invention.

FIGS. 6 and 7 simply show combination locking and retaining tabs 38*c* and 42*c* formed in lap panels 33*a* and 34*a* which are formed according to U.S. Pat. No. 4,077,095 issued Mar. 7, 1978 and owned by the assignee of this invention. In this arrangement securing apertures 38*d* and 42*d* receive securing tabs 38*e* and 42*e* respectively.

INDUSTRIAL APPLICABILITY

This invention is particularly well suited for use in conjunction with packaging groups of articles which are similar to but slightly different in size and to which the invention is also applicable without requiring adjustment of machine tightening elements or of machine timing of such elements and thus provides a substantial degree of adaptability whereby packaging efficiency is substantially enhanced in connection with the use of article carriers of the wraparound type.

I claim:

1. In an article carrier of the wraparound type formed from a blank of generally rectangular configuration and having lap panels at its ends which are overlapped and secured together in flat face contacting relation in alternate relative positions of long and short overlaps to form tubular structures of different girths respectively, an improved interlocking means comprising a combination locking and retaining tab struck from each of said lap panels and defining a locking edge in each lap panel which is disposed at the swing end of the associated combination tab, one of said combination tabs being longer from its base to its swing end than the corresponding dimension of the other combination tab so that locking movement of said one combination tab from an outer overlapping position of the associated lap panel through the aperture defined by the other of said combination tabs causes the base of said one combination tab to engage the locking edge defined by the other combination tab to establish a predetermined girth for the carrier and so that locking movement of said other combination tab from an outer overlapping position of the associated lap panel through the aperture defined by said one of said combination tabs causes the base of said other combination tab to engage the locking edge defined by said one combination tab to establish a girth for the carrier which is different from said predetermined girth.

2. Interlocking means according to claim 1 wherein the girth of the carrier is less when said one combination tab and its associated lap panel are disposed in an outer overlapping position than when said other combination tab and its associated lap panel are disposed in an outer overlapping position.

3. Interlocking means according to claim 1 wherein a plurality of combination tabs are struck from each of said lap panels.

4. Interlocking means according to claim 3 wherein the combination tabs which are struck from each of said lap panels are transversely aligned with each other.

5. Interlocking means according to claim 1 wherein the girth of the carrier is approximately equal to the longitudinal distance between the base of the combination tab in the outer lap panel and the locking edge in the inner lap panel.

6. Interlocking means according to claim 1 wherein each of said locking edges includes an inwardly projecting securing tab and wherein a securing aperture is formed at the base of each of said combination tabs.

7. Interlocking means according to claim 6 wherein each of said securing tabs is disposed at approximately the mid point of the associated locking edge and each of said securing apertures is disposed approximately midway between the ends of the base of each of said combination tabs.

* * * * *